US007928709B2

(12) United States Patent
Erbito, Jr.

(10) Patent No.: US 7,928,709 B2
(45) Date of Patent: Apr. 19, 2011

(54) VOLTAGE REGULATOR AND AC-DC CONVERTER

(75) Inventor: Rogelio L. Erbito, Jr., Singapore (SG)

(73) Assignee: Vanguard International Semiconductor Corporation, Hsinchu (TW)

( * ) Notice: Subject to any disclaimer, the term of this patent is extended or adjusted under 35 U.S.C. 154(b) by 320 days.

(21) Appl. No.: 12/365,704

(22) Filed: Feb. 4, 2009

(65) Prior Publication Data

US 2010/0195358 A1 Aug. 5, 2010

(51) Int. Cl.
*G05F 1/565* (2006.01)
*G05F 1/59* (2006.01)

(52) U.S. Cl. ..... 323/274; 323/314; 323/317

(58) Field of Classification Search ..... 323/273, 323/274, 275, 279, 284, 285, 314, 315, 316, 323/317

See application file for complete search history.

(56) References Cited

U.S. PATENT DOCUMENTS

| | | | | |
|---|---|---|---|---|
| 5,714,872 | A * | 2/1998 | Heimerl et al. | 323/273 |
| 5,929,616 | A * | 7/1999 | Perraud et al. | 323/274 |
| 6,060,871 | A * | 5/2000 | Barker | 323/280 |
| 7,548,044 | B2 * | 6/2009 | Itoh et al. | 323/274 |

* cited by examiner

*Primary Examiner* — Gary L Laxton

(57) ABSTRACT

A voltage regulator is provided. An input node receives an input voltage. An output node provides a supply voltage. A first transistor is coupled between the input node and a node. A first resistor is coupled between the input node and a gate of the first transistor. A second transistor is coupled between the node and the output node. An amplifier includes a non-inverting input terminal for receiving a reference voltage and an inverting input terminal. A second resistor is coupled between the inverting input terminal and a ground. A third transistor is coupled between the second resistor and a gate of the second transistor, wherein the third transistor is controlled by an output of the amplifier. A fourth transistor is coupled between the third transistor and the first node, wherein a gate of the fourth transistor is coupled to the gate of the second transistor.

19 Claims, 2 Drawing Sheets

VOLTAGE REGULATOR AND AC-DC CONVERTER

BACKGROUND OF THE INVENTION

1. Field of the Invention

The invention relates to a voltage regulator, and more particularly to a voltage regulator of an AC-DC converter.

2. Description of the Related Art

In general, AC-DC converters are used to operate directly from an alternating current (AC) input line. In an AC-DC converter, a rectifier circuit may directly convert an AC input voltage from the AC line to a direct current (DC) voltage with ripples. A voltage regulator disposed in an output terminal of the rectifier circuit may regulate the DC voltage with ripples to reduce the ripples.

FIG. 1 shows a conventional AC-DC converter 100. The AC-DC converter 100 comprises a rectifier circuit 110 and a shunt regulator circuit 120. The rectifier circuit 110 converts a high AC voltage HVAC to a high DC voltage HVDC (single polarity voltage). The DC voltage HVDC is not a constant voltage due to the ripples thereof. In order to provide a steady DC voltage HVDC, a smoothing capacitor C1 is used to filter the DC voltage HVDC, so as to reduce the ripples. The regulator circuit 120 comprising a resistor R, a zener diode Z and a capacitor C2 may remove any remaining ripples, and maintain the regulation for various supply voltages and loads. The resistor R and the zener diode Z generate a regulated DC voltage according to the DC voltage HVDC. The capacitor C2 is connected across the zener diode Z to further reduce ripples and diode noise.

The rectifier circuit 110 and the shunt regulator circuit 120 are formed with discrete resistors, capacitors and diodes. However, discrete components increase costs and required printed circuit board area. Furthermore, due to a continuous current flowing through the resistor R and the zener diode Z, in the regulator circuit 120, power is continuously dissipated and loss. Meanwhile, if a conventional regulator circuit is supplied with a high voltage (such as 120V or 240V AC), power dissipation will worsen. Therefore, an ultra high voltage regulator is desired.

BRIEF SUMMARY OF THE INVENTION

Voltage regulators and AC-DC converters are provided. An exemplary embodiment of a voltage regulator is provided. An input node receives an input voltage and an output node provides a supply voltage. A first transistor is coupled between the input node and a first node. A first resistor is coupled between the input node and a gate of the first transistor. A second transistor is coupled between the first node and the output node. An amplifier has a non-inverting input terminal for receiving a reference voltage and an inverting input terminal. A second resistor is coupled between the inverting input terminal and a ground. A third transistor is coupled between the second resistor and a gate of the second transistor, wherein the third transistor is controlled by an output of the amplifier. A fourth transistor is coupled between the third transistor and the first node, wherein a gate of the fourth transistor is coupled to the gate of the second transistor.

Furthermore, an exemplary embodiment of an AC-DC-converter is provided. An input node receives an alternating current voltage, and an output node provides a supply voltage. A rectifier circuit converts the alternating current voltage to a direct current voltage. A voltage regulator receives the direct current voltage to generate the supply voltage. The voltage regulator comprises: a first transistor coupled between the rectifier circuit and a first node; a first resistor coupled between the rectifier circuit and a gate of the first transistor; a second transistor coupled between the first node and the output node; an amplifier having a non-inverting input terminal for receiving a reference voltage and an inverting input terminal; a second resistor coupled between the inverting input terminal and a ground; a third transistor coupled between the second resistor and a gate of the second transistor, wherein the third transistor is controlled by an output of the amplifier; a fourth transistor coupled between the third transistor and the first node, wherein a gate of the fourth transistor is coupled to the gate of the second transistor; a first switch coupled between the gate of the second transistor and the first node; and a determining circuit controlling the first switch according to the supply voltage and the reference voltage. The first switch is turned off when the reference voltage is larger than a first voltage, and the first switch is turned on when the reference voltage is smaller than a second voltage, wherein the first voltage is larger than the second voltage.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
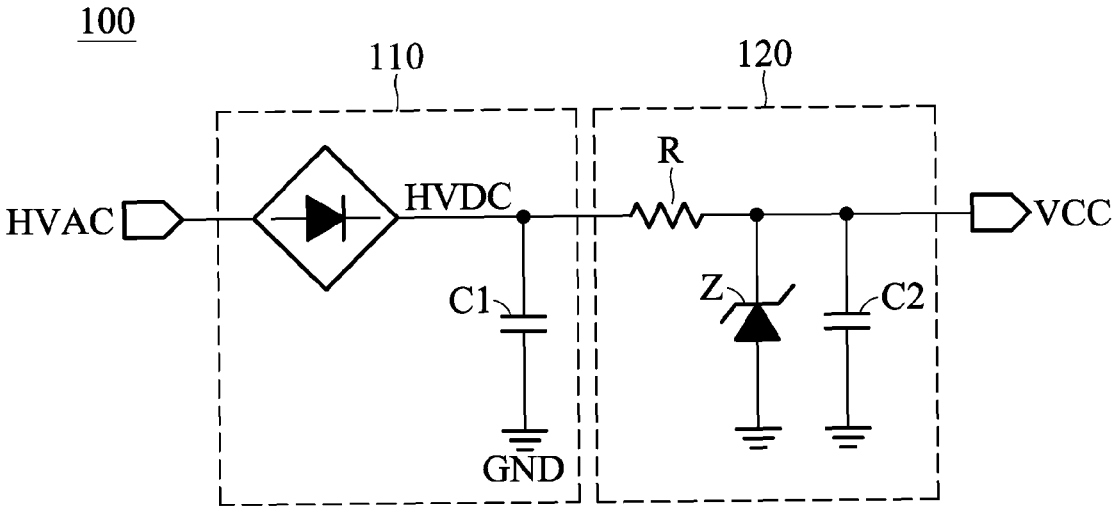
FIG. 1 (PRIOR ART)
FIG. 1 shows a conventional AC-DC converter.
Figure 2:
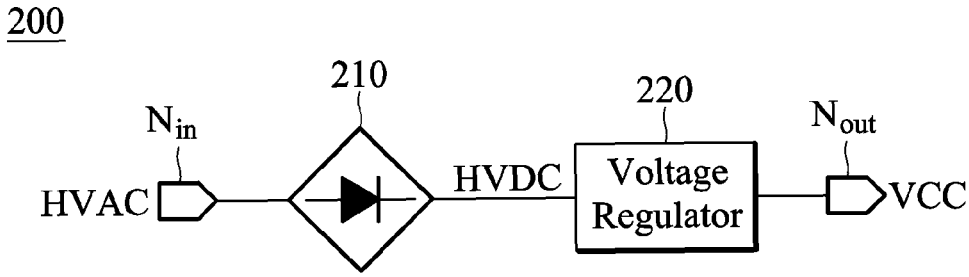
FIG. 2 shows an AC-DC converter according to an embodiment of the invention.

FIG. 2 shows an AC-DC converter 200 according to an embodiment of the invention. The AC-DC converter 200 receives a high AC voltage HVAC from an input node $N_{in}$ and provides a supply voltage VCC via an output node $N_{out}$. The AC-DC converter 200 comprises a rectifier circuit 210 and a voltage regulator 220. The rectifier circuit 210 is a discrete component due to its high blocking voltage and current capabilities. The rectifier circuit 210 converts the high AC voltage HVAC to a high DC voltage HVDC. The voltage regulator 220 regulates the high DC voltage HVDC to generate the supply voltage VCC. In one embodiment, the voltage regulator 220 may be implemented in an integrated circuit due to high voltage process capabilities of integrated circuits.

Figure 3:
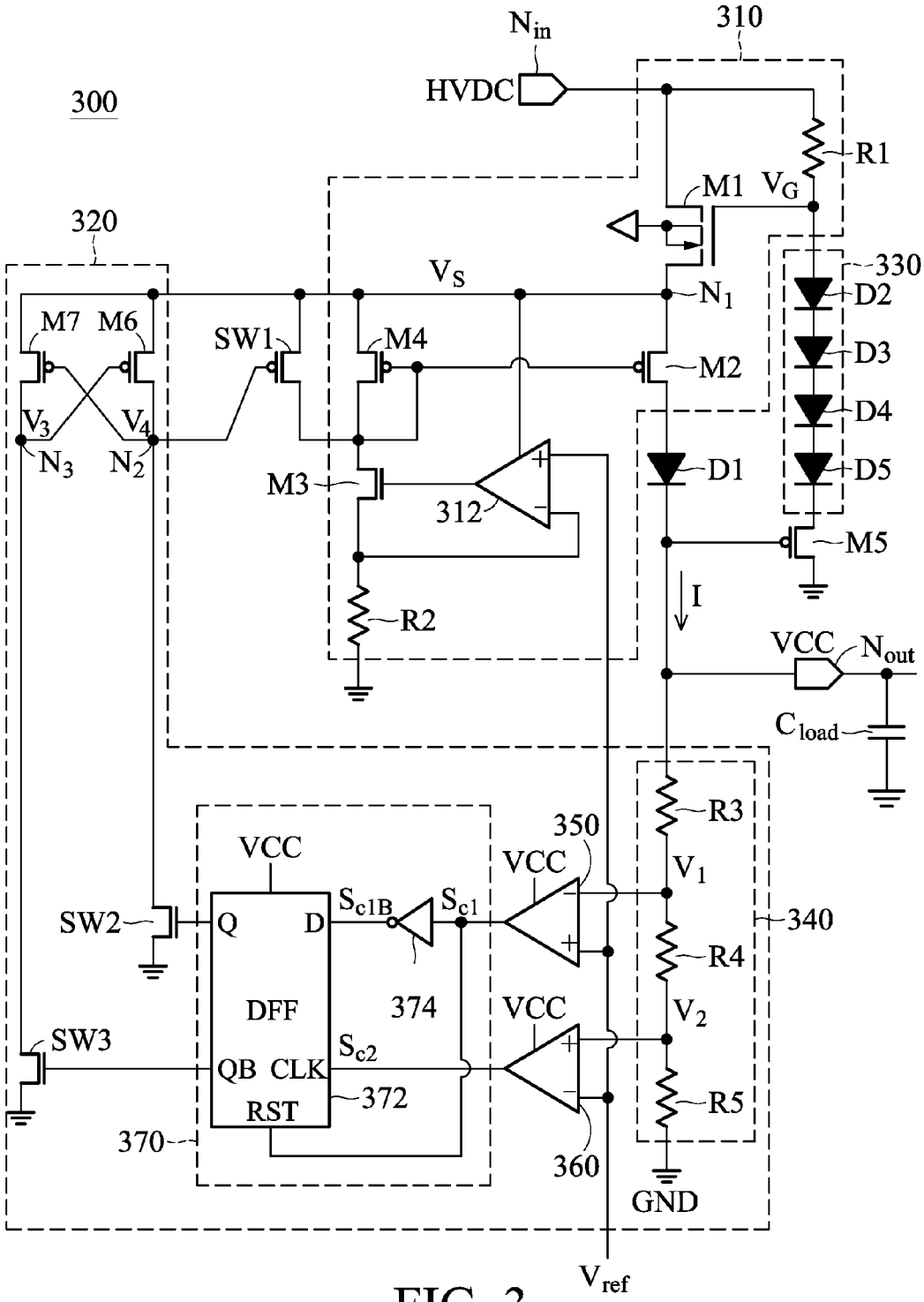
FIG. 3 shows a block diagram of a voltage regulator for an AC-DC converter according to an embodiment of the invention.

FIG. 3 shows a block diagram of a voltage regulator 300 for an AC-DC converter according to an embodiment of the invention. The voltage regulator 300 may receive an input voltage HVDC from an input node $N_{in}$ and provide a supply voltage VCC to a load $C_{load}$ via an output node $N_{out}$. The voltage regulator 300 comprises a main circuit 310 and a determining circuit 320. The voltage regulator 300 further comprises a transistor SW1, a diode D1, a transistor M5 and a diode chain 330. The transistor SW1 coupled between a gate of a transistor M2 and a node $N_1$ is a transistor which functions as a switch for controlling whether the main circuit 310 is operated or not. The diode D1 is coupled between the transistor M2 and the output node $N_{out}$. The diode chain 330 has four diodes D2-D5, each coupled in a forward conduction direction from a gate of a transistor M1 to the transistor M5. The transistor M5 is coupled between the diode chain 330 and a ground GND, and has a gate coupled to the output node $N_{out}$. In this embodiment, the transistor M5 and the diode chain 330 may form a protection circuit to avoid increase of voltages $V_G$ and $V_S$ to more than the breakdown voltages of the devices in the voltage regulator 300.

In the main circuit 310, the transistor M1 and a resistor R1 are the high voltage devices which may withstand a very high voltage of up to 400V or more, depending upon which semiconductor process is implemented. During normal operation, the high voltage devices may experience large voltage drops across thereof, while operating at a low voltage. The resistor R1 is coupled between the input node $N_{in}$ and the diode chain 330. The transistor M1 is coupled between the input node $N_{in}$ and the node $N_1$, wherein a gate of the transistor M1 is coupled to the resistor R1, which may bias the transistor M1 to operate in a saturation region, thereby allowing a current to flow from the input node $N_{in}$ to the node $N_1$. As shown in FIG. 3, the voltage $V_G$ at the gate of the transistor M1 is equal to the supply voltage VCC plus a gate to source voltage of the transistor M5 and four diode voltage drops, which are the forward voltages across the diodes D2-D5. It is to be noted, that the number of diodes within the diode chain 330 is determined according to various designs and applications. A transistor M2 is coupled between the node $N_1$ and the diode D1 and a transistor M4 is coupled between the node $N_1$ and a transistor M3, wherein the transistors M2 and M4 form a current mirror pair which may control a current from the transistor M1 to the output node $N_{out}$. Moreover, the gates of the transistors M2 and M4 are coupled to the switch SW1. A current flowing through the transistor M4 is controlled by a transistor M3 coupled between the transistor M4 and a resistor R2, wherein the transistor M3 is controlled by an output signal of an amplifier 312 with a non-inverting input terminal for receiving a reference voltage $V_{ref}$ and an inverting input terminal coupled to the resistor R2. Hence, a current flowing through the transistor M2 may be calculated by the following Equation (1):

$$I_{M2} = I = K\left(\frac{V_{ref}}{R2}\right), \tag{1}$$

where K is a ratio of W/L (width/length) of the transistors M2 over M4. It is to be noted that the size of the transistor M2 is larger than that of the transistor M4, thus the current of the transistor M2 is larger than that of the transistor M4. Furthermore, the current flowing through the transistor M2 is the same current flowing through the transistor M1 and the diode D1, i.e. a current I. The diode D1 allows the current I to flow from the input node $N_{in}$ to the output node $N_{out}$, but blocks a reverse current coming from the output node $N_{out}$. The current I may charge the load $C_{load}$, thus forcing the supply voltage VCC to ramp up.

Referring to FIG. 3, the determining circuit 320 comprises a voltage dividing unit 340, two comparators 350 and 360, a control circuit 370 and four transistors M6, M7, SW2 and SW3. In the embodiment, each of the transistors SW2 and SW3 is a transistor which functions as a switch. The voltage dividing unit 340 is coupled between the output node $N_{out}$ and the ground GND and comprises the resistors R3, R4 and R5. Furthermore, the voltage dividing unit 340 is used to provide the voltages $V_1$ and $V_2$ according to the supply voltage VCC, wherein the voltages $V_1$ is larger than the voltages $V_2$. The resistor R4 is coupled between the resistors R3 and R5, and a difference between the voltages $V_1$ and $V_2$ is a voltage across the resistor R4. The comparator 350 compares the voltage $V_1$ and the reference voltage $V_{ref}$ to generate a comparing signal $S_{c1}$, and the comparator 360 compares the voltage $V_2$ and the reference voltage $V_{ref}$ to generate a comparing signal $S_{c2}$. The control circuit 370 controls the switches SW2 and SW3 according to the comparing signals $S_{c1}$ and $S_{c2}$. The control circuit 370 comprises a D Flip-Flop 372 and an inverter 374. The inverter 374 receives the comparing signal $S_{c1}$ to generate a signal $S_{c1B}$. The D Flip-Flop 372 comprises a data terminal D and a reset terminal RST for receiving the signal $S_{c1B}$, a clock terminal CLK for receiving the comparing signal $S_{c2}$ and two output terminals Q and QB, wherein the data provided by the output terminal QB is a complement of the data provided by the output terminal Q. The switch SW2 is coupled between a node $N_2$ and the ground GND, and has a control terminal coupled to the output terminal Q. The switch SW3 is coupled between a node $N_3$ and the ground GND, and has a control terminal coupled to the output terminal QB. The transistor M6 is coupled between the nodes $N_1$ and $N_2$, and the transistor M7 is coupled between the nodes $N_1$ and $N_3$, wherein the gates of the transistors M6 and M7 are coupled to the nodes $N_3$ and $N_2$, respectively. Moreover, a control terminal of the switch SW1 is coupled to the $N_2$.

Initially, the supply voltage VCC is at a low voltage level. Because the voltage $V_1$ is smaller than the reference voltage $V_{ref}$, the comparing signal $S_{c1}$ is at a logic level "1", thereby resetting the D Flip-Flop 372. Simultaneously, the comparing signal $S_{c2}$ is at a logic level "0". The signals provided by the output terminals Q and QB are forced to logic level "0" and "1", respectively, thus the switch SW2 is turned off and the switch SW3 is turned on. A voltage $V_3$ of the node $N_3$ is pulled down because the switch SW3 is turned on. Next, the voltage $V_3$ with a low voltage level may turn on the transistor M6 to pull up a voltage $V_4$ of the node $N_2$ since the switch SW2 is turned off. Next, the switch SW1 is turned off because of the voltage $V_4$ with a high voltage level. When the SW1 is turned off, the current mirror pair (the transistors M2 and M4) is operated normally, and the current I flowing through the transistor M2 may charge up the load $C_{load}$ to keep the supply voltage VCC ramping up. In the voltage dividing unit 340, the voltages $V_1$ and $V_2$ are increased in proportion to the supply voltage VCC, wherein the voltages $V_1$ and $V_2$ may be calculated by the following Equations (2) and (3), respectively:

$$V_1 = \left(\frac{R_2 + R_3}{R_1 + R_2 + R_3}\right) \times VCC \tag{2}$$

$$V_2 = \left(\frac{R_3}{R_1 + R_2 + R_3}\right) \times VCC. \tag{3}$$

When the supply voltage VCC continues to increase, the voltage $V_1$ may become higher than the reference voltage $V_{ref}$. Next, the comparing signal $S_{c1}$ is changed from a logic level "1" to "0", which readies the D Flip-Flop 372 to accept a clock signal. As the supply voltage VCC continues to increase, the voltage $V_2$ may become higher than the reference voltage $V_{ref}$, then the comparing signal $S_{c2}$ is changed from a logic level "0" to "1". A transition of the comparing signal $S_{c2}$ may trigger the D Flip-Flop 372 to change its output state since the D Flip-Flop 372 is an edge triggered D Flip-Flop. An initial state of the signal provide by the output terminal Q is at logic level "0". After triggering, the state of the signal provided by the output terminal Q may become a logic level "1" due to the input signal $S_{c1B}$ of the D Flip-Flop 372 being at a logic level "1".

After the output state of the D Flip-Flop 372 is changed, the switch SW2 is turned on and the switch SW3 is turned off. Hence, the voltage $V_4$ is pulled down such that the switch SW1 is turned on. Next, the gates and sources of the transistors M2 and M4 are shorted, which may turn the transistors M2 and M4 off and stop the current I to flow through the transistor M2. If the current I is stopped, the charging current of the load $C_{load}$ may be stopped, and then the load $C_{load}$ may start to discharge. Next, the supply voltage VCC starts to ramp down until the voltage $V_1$ drops to slightly lower than the reference voltage $V_{ref}$. As described above, if the voltage $V_1$ is smaller than the reference voltage $V_{ref}$, the comparing signal $S_{c1}$ may change to a logic level "1" to reset the D Flip-Flop 372. Next, the switch SW3 is turned on and the switch SW2 is turned off, such that the voltages $V_S$ and $V_4$ are the same. Next, the switch SW1 is turned off, and then the operation of the current mirror pair is restored, so as to ramp up the supply voltage VCC. Hence, the supply voltage VCC may be increased to a maximum voltage value and decreased to a minimum voltage value, wherein the maximum and minimum voltage values are determined according to the reference voltage $V_{ref}$. For example, the maximum voltage value is determined when the voltage $V_2$ is larger than the reference voltage $V_{ref}$, and the minimum voltage value is determined when the voltage $V_1$ is smaller than the reference voltage $V_{ref}$, wherein the voltages $V_1$ and $V_2$ are given according to the Equations (2) and (3), respectively. Furthermore, the maximum and minimum voltage values may form an operating window voltage of the supply voltage VCC.

By switching on and off the current I flowing through the voltage regulator 300, average power dissipation is reduced since the supply voltage VCC is not always at peak levels during all times and the current I is intermittent. Furthermore, the voltage regulator 300 may be implemented in an integrated circuit to reduce required area and costs for printed circuit boards.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A voltage regulator, comprising:

an input node receiving an input voltage;

an output node providing a supply voltage;

a first transistor coupled between the input node and a first node;

a first resistor coupled between the input node and a gate of the first transistor;

a second transistor coupled between the first node and the output node;

an amplifier having a non-inverting input terminal for receiving a reference voltage and an inverting input terminal;

a second resistor coupled between the inverting input terminal and a ground;

a third transistor coupled between the second resistor and a gate of the second transistor, wherein the third transistor is controlled by an output of the amplifier; and a fourth transistor coupled between the third transistor and the first node, wherein a gate of the fourth transistor is coupled to the gate of the second transistor.

2. The voltage regulator as claimed in claim 1, further comprising:

a first diode coupled between the second transistor and the output node, blocking a reverse current from the output node.

3. The voltage regulator as claimed in claim 1, further comprising:

a diode chain coupled to the gate of the first transistor, having a plurality of second diodes connected in series; and a fifth transistor coupled between the diode chain and the ground, having a gate coupled to the output node, wherein the second diode is coupled in a forward conduction direction from the gate of the first transistor to the fifth transistor.

4. The voltage regulator as claimed in claim 1, further comprising:

a first switch coupled between the gate of the second transistor and the first node, having a control terminal coupled to a second node; and a determining circuit controlling the first switch according to the supply voltage and the reference voltage.

5. The voltage regulator as claimed in claim 4, wherein the determining circuit comprises:

a voltage dividing unit, providing a first voltage and a second voltage according to the supply voltage, wherein the first voltage is larger than the second voltage;

a first comparator comparing the first voltage with the reference voltage to generate a first comparing signal; and a second comparator comparing the second voltage with the reference voltage to generate a second comparing signal, wherein the first switch is turned off when the first comparing signal indicates that the reference voltage is larger than the first voltage, and the first switch is turned on when the second comparing signal indicates that the reference voltage is smaller than the second voltage.

6. The voltage regulator as claimed in claim 5, wherein the voltage dividing unit comprises:

a third resistor coupled to the output node;

a fourth resistor coupled to the third resistor; and a fifth resistor coupled between the fourth resistor and the ground, wherein a difference between the first voltage and the second voltage is a voltage across the fourth resistor.

7. The voltage regulator as claimed in claim 5, wherein the determining circuit further comprises:

a sixth transistor coupled between the first node and the second node, having a gate coupled to a third node;

a seventh transistor coupled between the first node and the third node, having a gate coupled to the second node;

a second switch coupled between the second node and the ground;

a third switch coupled between the third node and the ground; and a control circuit controlling the second switch and the third switch according to the first comparing signal and the second comparing signal, wherein the second switch is turned off and the third switch is turned on when the first comparing signal indicates that the reference voltage is larger than the first voltage, and the second switch is turned on and the third switch is turned off when the second comparing signal indicates that the reference voltage is smaller than the second voltage.

8. The voltage regulator as claimed in claim 7, wherein the control circuit comprises:

a inverter inverting the first comparing signal; and a D Flip-Flop comprising a data terminal for receiving the inverted first comparing signal, a clock terminal for receiving the second comparing signal, a reset terminal for receiving the first comparing signal, a first output terminal for providing a first output data to the second switch and a second output terminal for providing a second output data to the third switch, wherein the second output data is a complement of the first output data.

9. The voltage regulator as claimed in claim 1, wherein the second transistor and the fourth transistor form a current mirror pair, and a size of the second transistor is larger than that of the fourth transistor.

10. The voltage regulator as claimed in claim 1, wherein the first transistor and the first resistor are the high voltage devices.

11. An AC-DC converter, comprising:

an input node receiving an alternating current voltage;

an output node providing a supply voltage;

a rectifier circuit converting the alternating current voltage to a direct current voltage; and a voltage regulator receiving the direct current voltage to generate the supply voltage, comprising:

a first transistor coupled between the rectifier circuit and a first node;

a first resistor coupled between the rectifier circuit and a gate of the first transistor;

a second transistor coupled between the first node and the output node;

an amplifier having a non-inverting input terminal for receiving a reference voltage and an inverting input terminal;

a second resistor coupled between the inverting input terminal and a ground;

a third transistor coupled between the second resistor and a gate of the second transistor, wherein the third transistor is controlled by an output of the amplifier;

a fourth transistor coupled between the third transistor and the first node, wherein a gate of the fourth transistor is coupled to the gate of the second transistor;

a first switch coupled between the gate of the second transistor and the first node; and a determining circuit controlling the first switch according to the supply voltage and the reference voltage, wherein the first switch is turned off when the reference voltage is larger than a first voltage, and the first switch is turned on when the reference voltage is smaller than a second voltage, wherein the first voltage is larger than the second voltage.

12. The AC-DC converter as claimed in claim 11, wherein the voltage regulator further comprising:

a first diode coupled between the second transistor and the output node, blocking a reverse current from the output node.

13. The AC-DC converter as claimed in claim 11, wherein the voltage regulator further comprising:

a diode chain coupled to the gate of the first transistor, having a plurality of second diodes connected in series; and a fifth transistor coupled between the diode chain and the ground, having a gate coupled to the output node, wherein the second diode is coupled in a forward conduction direction from the gate of the first transistor to the fifth transistor.

14. The AC-DC converter as claimed in claim 11, wherein the determining circuit comprises:

a voltage dividing unit, providing the first voltage and the second voltage according to the supply voltage;

a first comparator comparing the first voltage with the reference voltage to generate a first comparing signal; and a second comparator comparing the second voltage with the reference voltage to generate a second comparing signal, wherein the first switch is turned off when the first comparing signal indicates that the reference voltage is larger than the first voltage, and the first switch is turned on when the second comparing signal indicates that the reference voltage is smaller than the second voltage.

15. The AC-DC converter as claimed in claim 14, wherein the voltage dividing unit comprises:

a third resistor coupled to the output node;

a fourth resistor coupled to the third resistor; and a fifth resistor coupled between the fourth resistor and the ground, wherein a difference between the first voltage and the second voltage is a voltage across the fourth resistor.

16. The AC-DC converter as claimed in claim 14, wherein the determining circuit further comprises:

a sixth transistor coupled between the first node and the second node, having a gate coupled to a third node;

a seventh transistor coupled between the first node and the third node, having a gate coupled to the second node;

a second switch coupled between the second node and the ground;

a third switch coupled between the third node and the ground; and a control circuit controlling the second switch and the third switch according to the first comparing signal and the second comparing signal, wherein the second switch is turned off and the third switch is turned on when the first comparing signal indicates that the reference voltage is larger than the first voltage, and the second switch is turned on and the third switch is turned off when the second comparing signal indicates that the reference voltage is smaller than the second voltage.

17. The AC-DC converter as claimed in claim 16, wherein the control circuit comprises:

a inverter inverting the first comparing signal; and a D Flip-Flop comprising a data terminal for receiving the inverted first comparing signal, a clock terminal for receiving the second comparing signal, a reset terminal for receiving the first comparing signal, a first output terminal for providing a first output data to the second switch and a second output terminal for providing a second output data to the third switch, wherein the second output data is a complement of the first output data.

18. The AC-DC converter as claimed in claim 11, wherein the second transistor and the fourth transistor form a current mirror pair, and a size of the second transistor is larger than that of the fourth transistor.

19. The AC-DC converter as claimed in claim 11, wherein the first transistor and the first resistor are the high voltage devices.

* * * * *